United States Patent [19]

Reinhorn

[11] 4,251,994

[45] Feb. 24, 1981

[54] AIR POWERED SOURCE FOR COOLED BREATHABLE AIR

[76] Inventor: Edwin Reinhorn, 9650 Jimzel Rd., La Mesa, Calif. 92041

[21] Appl. No.: 67,942

[22] Filed: Aug. 20, 1979

[51] Int. Cl.[3] ..... F25D 15/00; F25D 23/12; F25D 9/00

[52] U.S. Cl. ..... 62/237; 62/259 B; 62/402

[58] Field of Search ..... 62/299, 259 B, 401, 62/402, 237, 172, 531, 87; 98/50; 128/205.25; 239/139, 291; 165/59

[56] References Cited

U.S. PATENT DOCUMENTS

| | | | |
|---|---|---|---|
| 2,819,590 | 1/1958 | Green | 62/172 X |
| 2,850,325 | 9/1958 | Suess | 239/139 X |
| 3,320,765 | 5/1967 | Chapple et al. | 62/237 X |
| 3,399,545 | 9/1968 | Anderson et al. | 62/237 |
| 3,515,135 | 6/1970 | Flower et al. | 128/205.25 |
| 3,777,506 | 12/1973 | Hergatt | 62/237 |
| 3,859,816 | 1/1975 | McDonald | 98/50 X |
| 3,878,692 | 4/1975 | Steves | 62/402 X |

FOREIGN PATENT DOCUMENTS

| | | | |
|---|---|---|---|
| 1086505 | 2/1955 | France | 62/259 |

*Primary Examiner*—Lloyd L. King
*Attorney, Agent, or Firm*—Ralph S. Branscomb

[57] ABSTRACT

A breathing apparatus is provided which delivers cool, air conditioned air to a remote location as much as 100 feet away from the apparatus proper. The unit is powered by an air motor operable from an industrial compressed air tank, and an oil-less pump is driven by the air motor to elevate the pressure of fresh air adequately for remote delivery. Cooling of both the drive air and the respirable fresh air is provided by radiators, and a final cooling stage is incorporated as a heat exchanger which cools the fresh air from the spent drive air, the latter having reached a very low temperature due to the rapid expansion of the air as it passes through the air motor. After the air from the compressor is used first to drive the pump drive motor and then through the heat exchanger to cool the breathable air, it is used yet a third time in the preferred embodiment by transmitting it with the breathing air in a hermetically separate cooling envelope so that virtually all of the energy used to initially compress the air is recouped to the greatest extent physically possible.

10 Claims, 4 Drawing Figures

AIR POWERED SOURCE FOR COOLED BREATHABLE AIR

BACKGROUND OF THE INVENTION

The invention is in the field of devices which provide breathable air to workers and others who are operating under conditions in which the ambient air is not suitable for breathing. Such breathing apparatus fall into three categories according to the level of danger, and the type of danger, at the working area. First, a simple mask respirator having a filter can be used in areas high in dust or other particulate matter, there being no collateral equipment required other than simply the filter and the mask.

Another respiratory protection unit is the self-contained breathing apparatus which must be used according to Federal Regulations in any area in which the ambient air is so poisonous that the user would die in the event his supply of artificial air were suddenly terminated. The third type of breathing equipment is the type to which this patent application pertains, namely, in-line breathing equipment which is used where continuous breathing of ambient air could harm the worker, such as in a spray-painting booth, in certain areas of steel mills, at sand blasting operations, and elsewhere. In these locations temporary deprivation of the artificial air would not result in death, but continued breathing of the ambient air would most certainly result in lung damage.

Units of this latter category provide air through hoses or lines from a remote source. These systems at one time were commonly hoses and masks hooked to the existing compressed air tank and for power in the factory, at the paint booth, at the sandblasting site, etc. However, a few years ago it was discovered that lubricating oil in the cylinders of these high-pressure compressed air pumps was oxidizing into carbon monoxide due to abnormal heat generated by worn pistons and cylinders in old systems. This was believed to have caused many deaths formerly believed due to heart failure, and as a result of this discovery, stringent rules have been promulgated requiring different filters and chemical and electrical alarms, some with automatic shut-off features.

High pressure systems with these safety devices on them would appear to provide the answer to in-line breathing equipment requirements, but for several reasons this is not the case. First, the rough wear the equipment is subject to may disable the alarm system without anyone being aware of it. Also, sometimes an audio alarm would be triggered without being heard by the user, who may be working in an environment high in ambient noise.

Ironically, even when the safety equipment is working perfectly, it can cause real problems on the job site, because if a carbon monoxide sensor is triggered, it is often impossible to isolate the cause of it, and safety inspectors will not permit re-mobilization of the equipment without correcting the malfunction.

To avoid all these problems, the inventor of the instant machine developed an in-line breathing apparatus that used a high-volume, low-pressure oil-less centrifugal pump which eliminated all of the safety problems, and thus all of the problems with safety equipment inherent in the high pressure systems. These systems did, and still do, work quite well. There has, however, heretofore been a practical problem with the low-pressure units, namely, that of air conditioning the breathable air.

High pressure systems deliver air to the vicinity of the user at elevated temperatures due to undissipated heat compression, but by use of a vortex tube a few inches from the face mask, a cooling effect can be implemented. However, the vortex effect requires about 65 pounds of pressure to operate, a pressure level impossible to achieve economically in centrifugal oil-less pumps. Thus, it is the goal of the invention of the hereindescribed apparatus to provide, with the use of a low-pressure oil-less pump, air conditioned air at the face mask.

SUMMARY OF THE INVENTION

The present invention utilizes for its energy source industrial compressed air which operates an air motor that is completely separate from the air used for breathing purposes. The air motor turns a pump which draws ambient air (the apparatus is placed in a safe breathing zone) in and increases the pressure to the point that it can be delivered reliably through a hose to a utilization means 100 feet or more from the source. Ambient air, after having been increased in pressure, cycles through a heat-dissipating radiator to bring it back to ambient temperature or close to it. It is then passed through a heat exchanger where it dissipates much more of its heat to air from the industrial compressed air tank which has passed through the air motor and very cold (on the order of 10°–15° Fahrenheit) by virtue of its sudden expansion to atmospheric pressure. Thus the cooling capacity inherent in high pressure air is utilized without the need to breathe the air from this less than ideal source.

From the heat exchanger, the respirable air passes out through a hose to the respirator mask and, in the preferred embodiment, the colder compressor motor drive air passes through a sheath which envelopes the hose and vents adjacent the mask so that the still colder compressor air from the heat exchanger continues to cool and insulate the breathable air until it reaches its destination. In this fashion, every advantage of cool, safe air at the work site is provided with none of the safety, reliability and down-time disadvantages of high pressure air systems.

DETAILED DESCRIPTION OF THE PREFERRED EMBODIMENT

Figure 1:
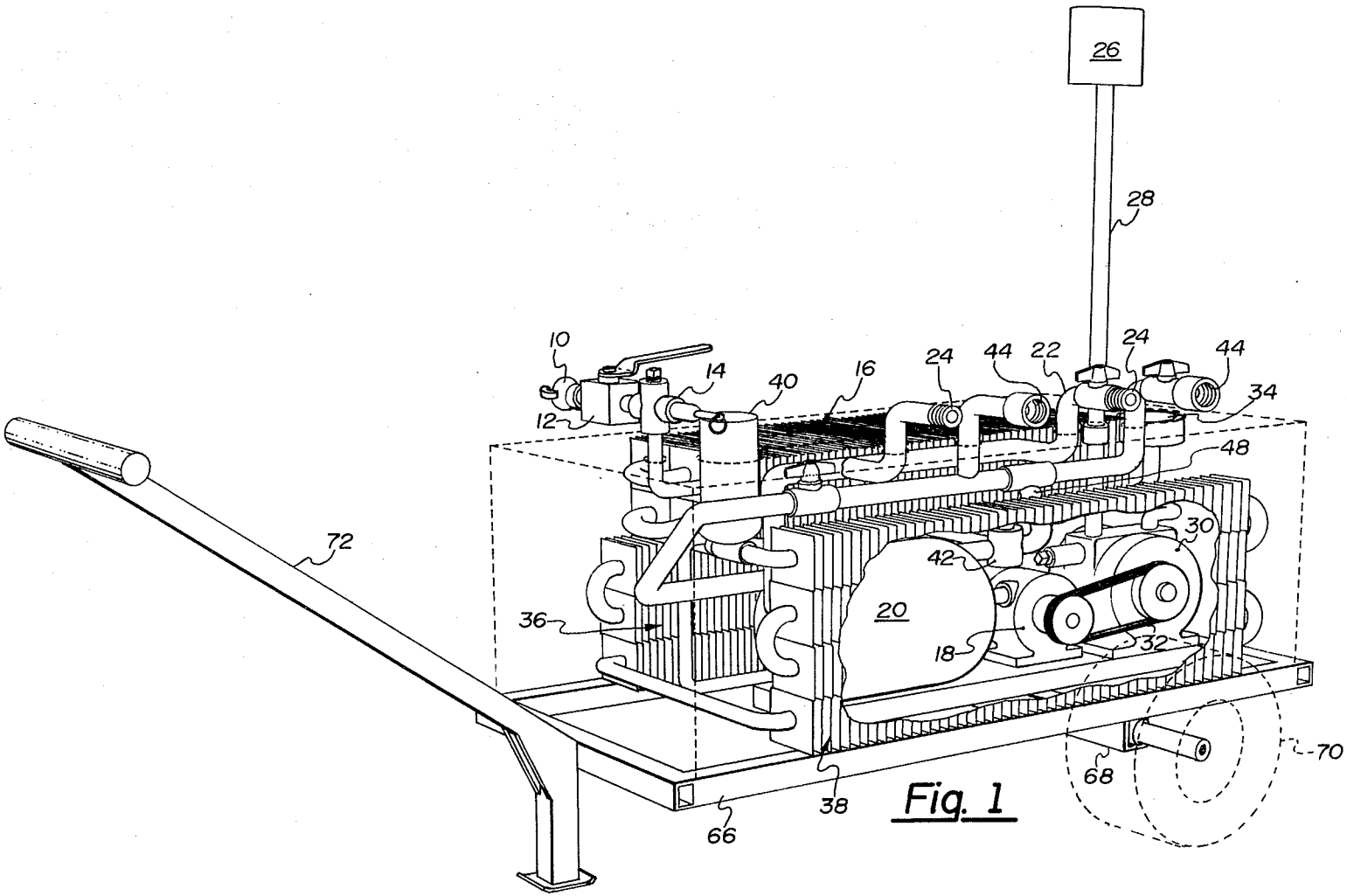
FIG. 1 is a perspective view of the apparatus with portions of a radiator cut away to reveal the working parts.
Figure 2:
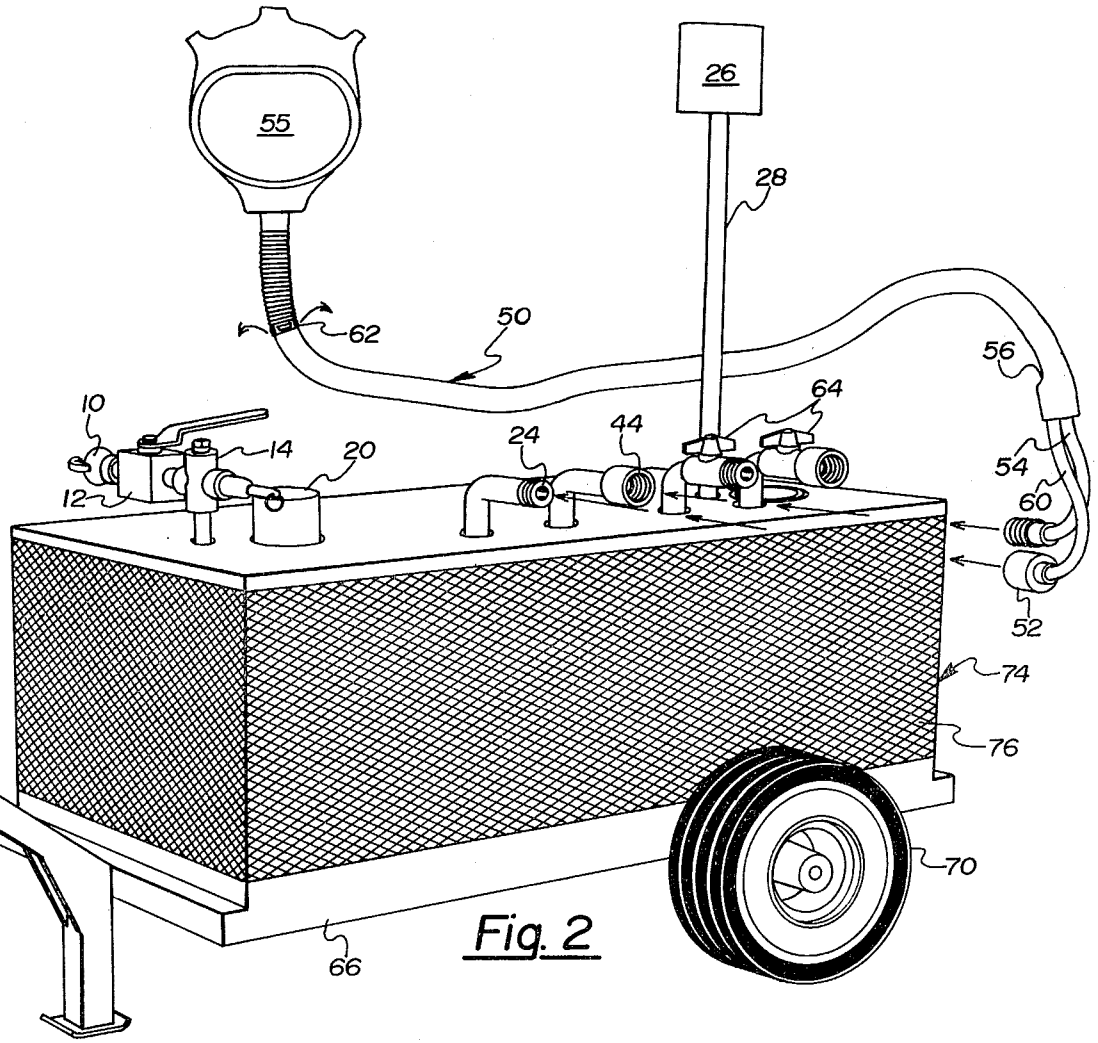
FIG. 2 is a perspective view identical to FIG. 1 but with the protective cover in place and showing the respiratory mask connection.
Figure 4:
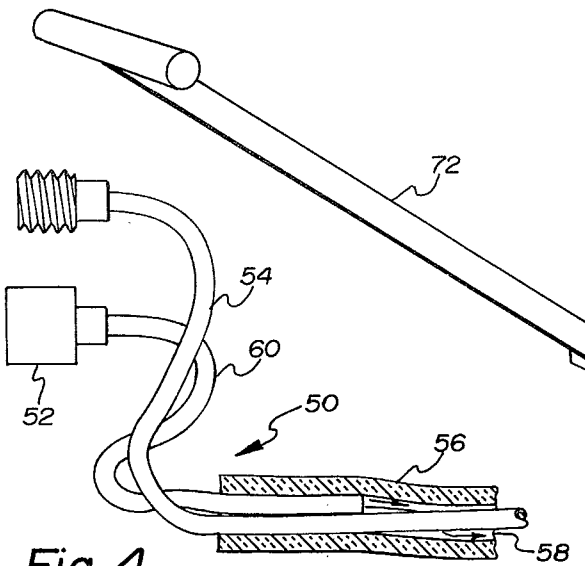
Figure 3:
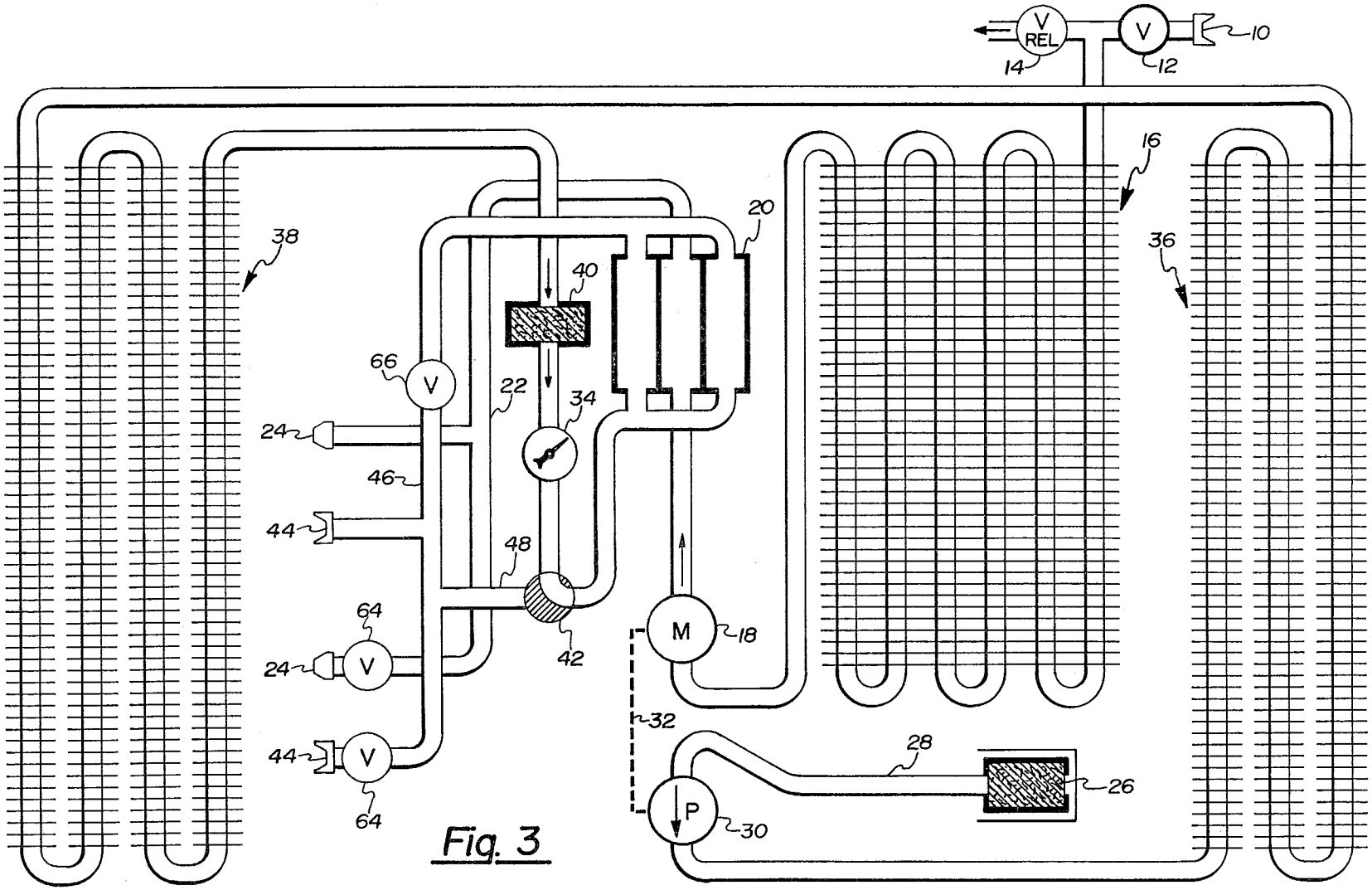
FIG. 3 is a diagrammatic view illustrating the functioning of the apparatus.

The invention is best understood from simultaneous initial reference to FIGS. 1 and 3 to comprehend the functioning of the apparatus, together with its physical manifestation. There are two separate pneumatic systems which work together while maintaining their separate integrity, the first being the high pressure, industrial compressed air supply utilized for power and then used again for cooling and will be described below, with the second system being the actual respirable air conducted to the face mask of the user.

The compressed air is coupled into the system at 10 through shut-of valve 12 and, provided parallel feeder pipe valve 14 is shut, the compressed air is introduced into a first radiator 16. Air entering this radiator is ordinarily at a relatively high temperature as it has just recently been compressed, having been withdrawn from its storage tank prior to dissipating its heat of compression. However, by the time the air completes its passage through the first radiator, it has been reduced to substantially the ambient temperature.

Having completed the first leg of its journey, the compressed air enters the air driven motor 18 from which it exits spent of most of its pressure and at a temperature must below ambient, on the order of 10°–15° Fahrenheit. This air enters the heat exchanger 20 and is passed to manifold 22 where it is made available at male couplings 24 for connection to a line.

The fresh air system initiates at a primary filter 26 from which it is drawn down the standpipe 28 and into the air pump 30 which is belt-driven as shown at 32 by the air motor 18. The air pump 30 is of the oil-less variety to eliminate the possibility of carbon monoxide poisoning.

The fresh air, after passing through the air pump 30, enters a secondary radiator which is comprised of two physically separated parts 36 and 38, the two part design being implemented soley for the purpose of properly positioning the parts in a compact manner on a frame. The air after it exits this second radiator passes through a secondary filter 40 where it is monitored by pressure gauge 34, effective in indicating clogging of either of the filters, and then enters the bypass valve 42. In the position shown in FIG. 3, the bypass valve is inoperative and the fresh air is passed through heat exchanger 20 from which it exits, being much cooled from the contact with the cold spent air from the outlet of the motor 18, and is made available at the female couplings 44 of the manifold 46. The bypass valve 42, when turned into its bypass position, routes the air directly to bypass inlet 48 and is used in circumstances in which cooling of the respirable air beyond that which is inherent in the use of the second radiator 36 and 38 is not required or is not desirable.

It can be seen now that the apparatus as thus described provides dual sources of non-respirable, cold air from the power compressor at the couplings 24, and cooled respirable air is provided at the couplings 44. This air is utilized in the lifeline 50 as follows. Coupling 52 mates with one of the fresh air outlets 24 and delivers the cool, respirable air through a central hose 54 which terminates in a respiration mask 55. This hose could be insulated and, even absent the structure described below, would be effective in delivering a continuous cool air supply to the user due to the double utilization of the compressed air, first for powering the pump and secondly for cooling the air supply.

However, in the preferred embodiment, surrounding the central hose 54 is an outer sheath 56 which defines an air envelope 58 around the hose. An adaptor line 60 is provided with an appropriate fitting to mate with either of the compressed air outlets 44 so that the air from the industrial compressor, still very cold even though having absorbed some of the heat from the fresh air in the heat exchanger 20, passes around the fresh air hose 54 throughout the length of the hose until it is vented at 62. It can thus be seen that the cooling capacity of both the respirable and the non-respirable air supplies is utilizes absolutely to its fullest, resulting in the provision at the respirator mask 55 of a supply of cool, breathable air to someone who may be working in otherwise intensly hot and unpleasant conditions.

Other collateral structure of the apparatus includes a pair of valves 64 which can be used to shut off the second set of outlets, which are used with a second lifeline 50, when said second lifeline is not required. A cold fresh air shutoff valve 66 is also included.

The physical manifestation of the unit also incorporates a frame having a base member 66 which mounts an axle 68 for the wheel 70. Preferably the axle 68 is removable from the frame, as is the combination tongue and support leg 72, so that in the event a high degree of mobility is not required it need not be provided.

Also, a protective cover 74 having ventilated sidewalls of diamond mesh or the like at 76 encloses the entire apparatus as an integral unit.

Being thus neatly packaged, mobile, completely safe and lightweight, and utilizing compressed air to the ultimate in efficiency, the unit is ideal for use in any application requiring an in-line breathing apparatus.

What is claimed is:

1. An air conditioned breathing apparatus comprising:

(a) a motor;

(b) an oil-less fresh air pump having an inlet and an outlet and being driven by said motor providing a source of pressurized respirable air;

(c) a hose connected at its first end to said pump outlet and at the second end to a respiratory utilization means;

(d) a sheath surrounding said hose to define an enclosing air envelope and including a supply of continuous cold air connected to said sheath at the end thereof adjacent the first end of said hose and venting to the atmosphere at the end thereof adjacent said utilization means whereby a continuous supply of cooled respirable air can be provided at a location remote from said pump and motor.

2. The structure according to claim 1 wherein said motor is an air motor and said supply of continuous cold air comprises the spent, expanded air from said motor.

3. The structure according to claim 2 and including a first heat dissipation radiator and means passing compressed air to be used to drive said motor through said radiator prior to said air being introduced into said motor.

4. The structure according to claim 2 and further including a second fresh air heat dissipation radiator connected between said hose and said pump outlet.

5. The structure according to claim 4 and including a heat exchanger operatively connected to exchange heat between spent air exiting said first radiator and fresh air exiting said second radiator.

6. The structure according to claim 5 and including a manifold means with a pair of outlet pipes, one for fresh air and one for spent motor air, and valving means to alternatively supply said outlet for fresh air with either fresh air which passes through said heat exchanger or fresh air bypassing said heat exchanger.

7. The structure according to claim 4 wherein said motor, pump and radiator are mounted on a portable frame and including removable wheels and a pulling tongue whereby said frame is mobile.

8. An air conditioned breathing apparatus comprising:

(a) an air motor intaking compressed air and exhausting cold, expanded air;

(b) an oil-less fresh air pump driven by said motor;

(c) a heat exchanger thermally comingling the cold, expanded air exiting said air motor and fresh air delivered from said fresh air pump and after such comingling, dissipating said expanded air into the environment; and (d) a fresh air utilization outlet making available for use fresh air delivered through said pump and heat exchanger uncontaminated by said expanded air.

9. The structure according to claim 8 and including a first radiator receiveing compressed air upstream from said air motor and a second radiator receiving fresh air downstream of said air motor and upstream of said heat exchanger.

10. The structure according to claim 8 and including a bypass valve and a circumventive passageway communicating with said outlet to permit selective circumvention of said heat exchanger in the event cooling of the fresh air is not desired.

* * * * *